US008103044B2

(12) United States Patent
Kaiya

(10) Patent No.: US 8,103,044 B2
(45) Date of Patent: Jan. 24, 2012

(54) SPEAKER DEVICE

(75) Inventor: Teruaki Kaiya, Tendo (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 537 days.

(21) Appl. No.: 12/438,669

(22) PCT Filed: Aug. 24, 2006

(86) PCT No.: PCT/JP2006/316577
§ 371 (c)(1),
(2), (4) Date: Feb. 24, 2009

(87) PCT Pub. No.: WO2008/023420
PCT Pub. Date: Feb. 28, 2008

(65) Prior Publication Data

US 2009/0190793 A1 Jul. 30, 2009

(51) Int. Cl.

| | |
|---|---|
| ***H04R 1/00*** | (2006.01) |
| ***H04R 11/02*** | (2006.01) |
| ***H04R 9/06*** | (2006.01) |
| ***H04R 1/02*** | (2006.01) |

(52) U.S. Cl. ..... 381/403; 381/353; 381/396; 381/400; 381/404; 381/405; 381/407; 381/410; 381/412; 381/413; 381/423; 381/424; 181/171; 181/172

(58) Field of Classification Search ..... 381/403
See application file for complete search history.

(56) References Cited

U.S. PATENT DOCUMENTS

| | | | | |
|---|---|---|---|---|
| 4,118,605 | A * | 10/1978 | Kobayashi | 381/407 |
| 5,014,323 | A * | 5/1991 | Markow et al. | 381/409 |
| 5,249,236 | A * | 9/1993 | Sakamoto | 381/409 |
| 6,130,955 | A * | 10/2000 | Aigner et al. | 381/403 |
| 6,501,844 | B2 * | 12/2002 | Proni | 381/403 |
| 6,714,656 | B1 * | 3/2004 | Coffin | 381/420 |
| 7,171,015 | B2 * | 1/2007 | Murayama et al. | 381/404 |
| 7,190,804 | B2 * | 3/2007 | Nakamura et al. | 381/423 |

(Continued)

FOREIGN PATENT DOCUMENTS

| | | | |
|---|---|---|---|
| JP | 57-74599 | U | 5/1982 |
| JP | 60-50594 | U | 4/1985 |
| JP | 2005-191746 | A | 7/2005 |

OTHER PUBLICATIONS

International Search Report of PCT/JP2006/316577, date of mailing Sep. 26, 2006.

*Primary Examiner* — Charles Garber
*Assistant Examiner* — Pape Sene
(74) *Attorney, Agent, or Firm* — Westerman, Hattori, Daniels & Adrian, LLP

(57) ABSTRACT

A voice coil 6 is movably disposed in a magnetic gap 5. A drive cone (first diaphragm) 11 and a diaphragm (second diaphragm) 14 are integrally driven by the voice coil 6. Peripheral edge portion of the drive cone 11 and the diaphragm 14 are supported by a frame 12 through edge portions 13 and 15, respectively.

An annular adhesive receiver 8 is disposed in a peripheral surface of a voice coil bobbin 7 around which the voice coil 6 is wound, and an inner peripheral edge 11*a* of the drive cone 11 is accommodated in the adhesive receiver 8. The drive cone 11, the adhesive receiver 8 and the voice coil bobbin 7 are connected to each other by an adhesive filled into the adhesive receiver 8.

7 Claims, 7 Drawing Sheets

U.S. PATENT DOCUMENTS

| | | | | |
|---|---|---|---|---|
| 7,844,071 | B2 * | 11/2010 | Funahashi et al. | 381/403 |
| 2004/0197007 | A1 * | 10/2004 | Onuma | 381/423 |
| 2004/0264731 | A1 * | 12/2004 | Nakamura et al. | 381/423 |
| 2005/0047625 | A1 * | 3/2005 | Matsuda et al. | 381/407 |
| 2005/0111690 | A1 * | 5/2005 | Onuma et al. | 381/424 |
| 2005/0141746 | A1 | 6/2005 | Kobayashi et al. | |
| 2006/0088181 | A1 * | 4/2006 | Kaiya et al. | 381/398 |
| 2009/0316948 | A1 * | 12/2009 | Kaiya | 381/398 |

* cited by examiner

[Fig. 1]
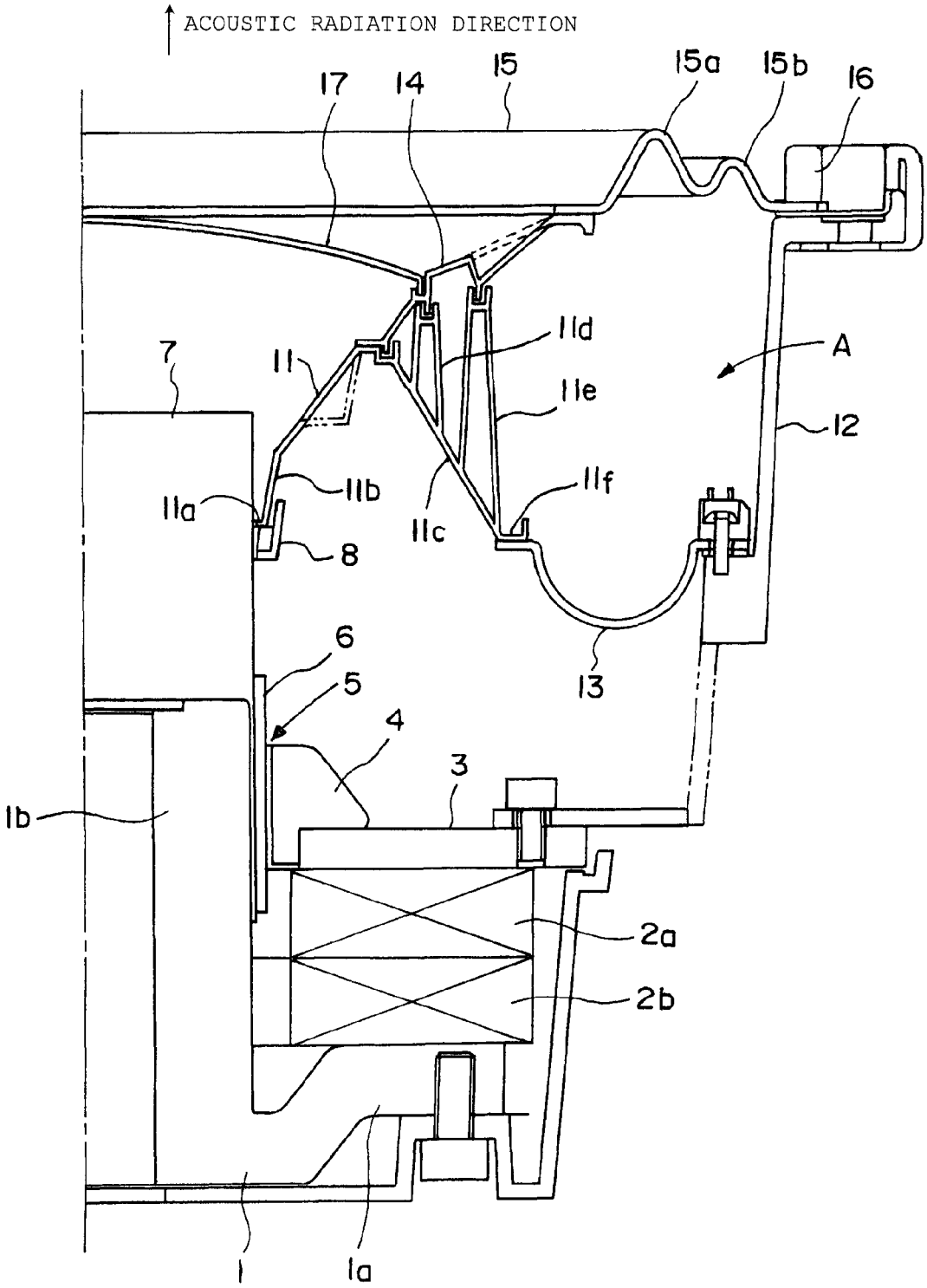

[Fig. 2]
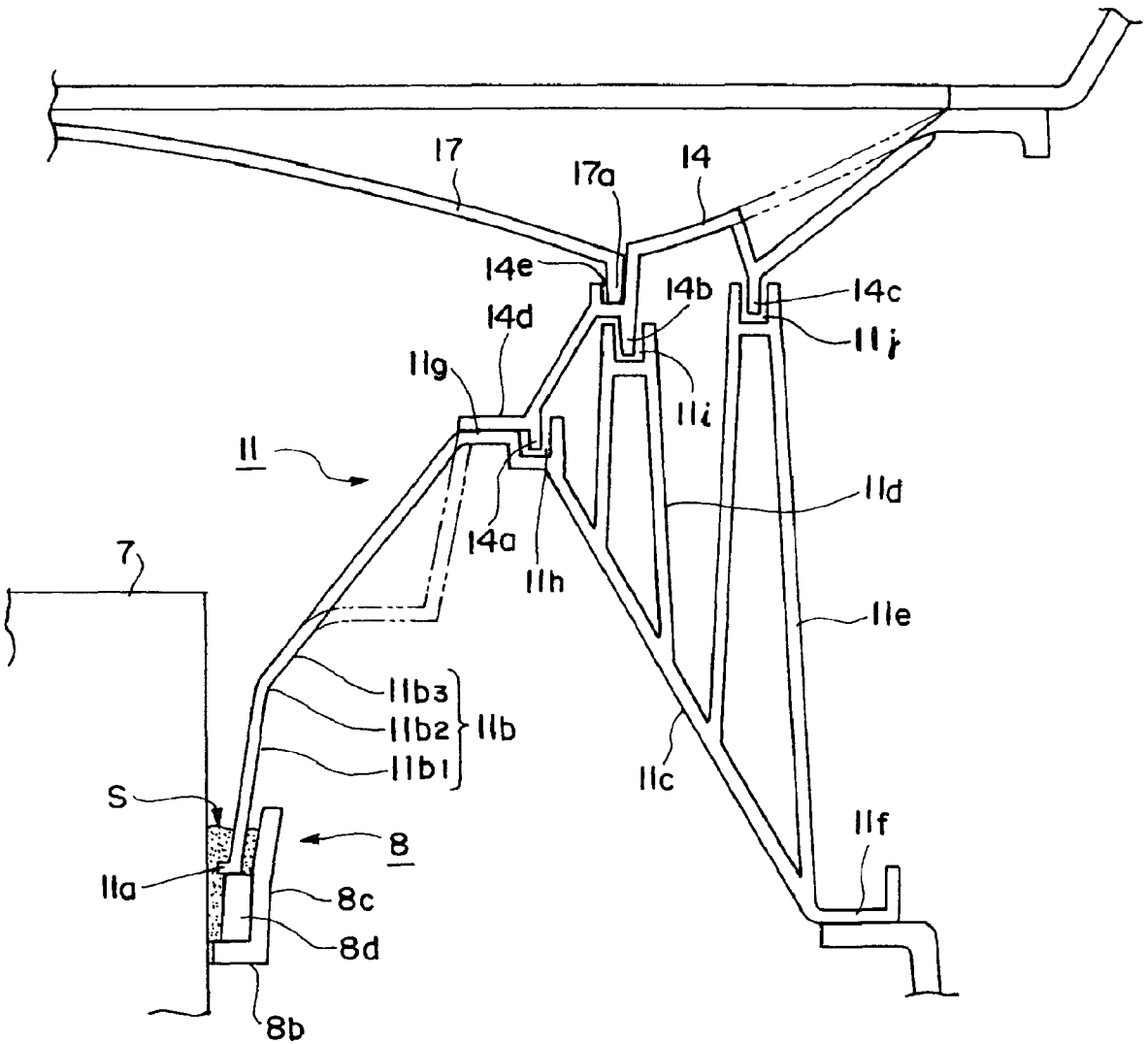

[Fig. 3]
(A)
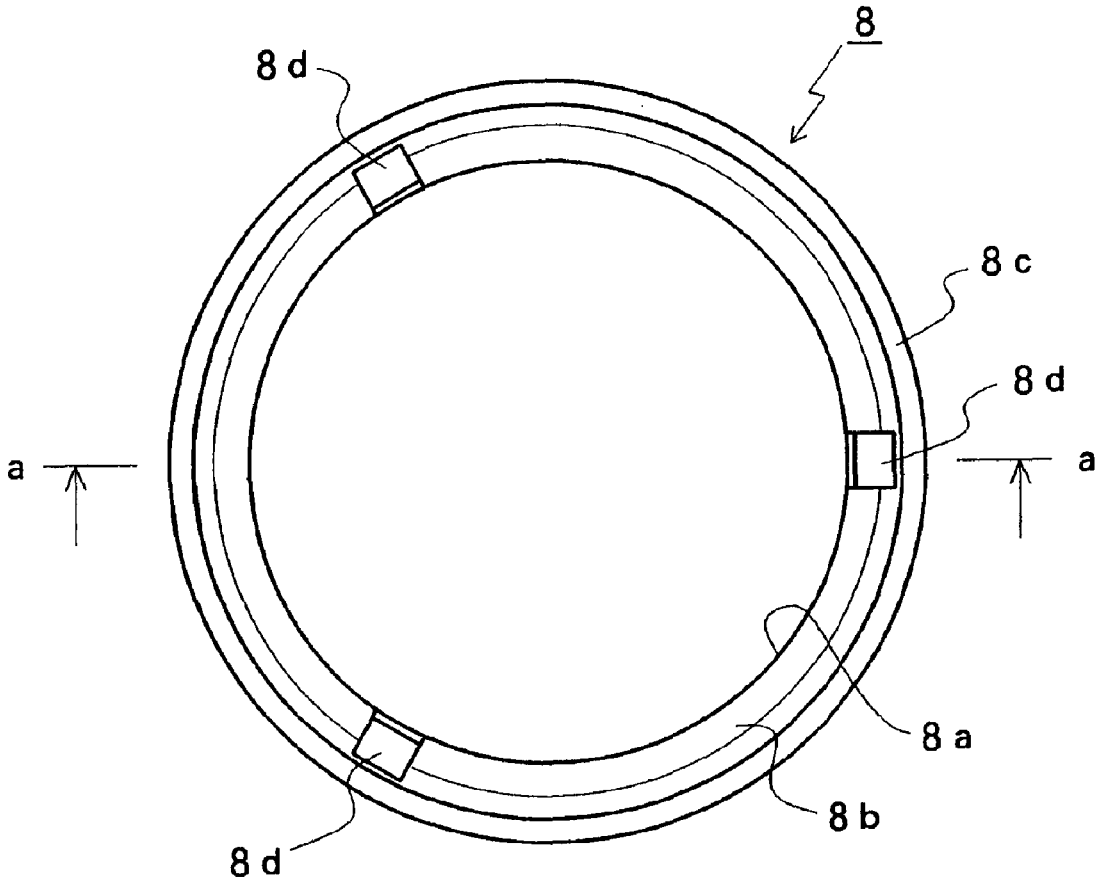
(B)
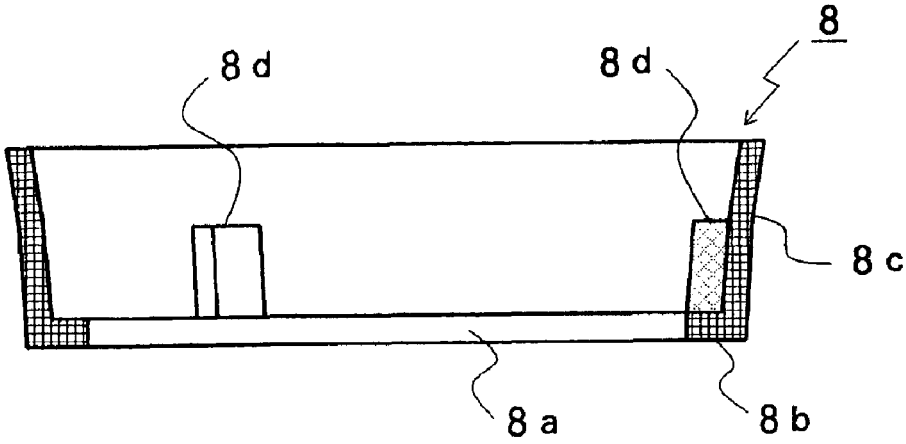

[Fig. 4]
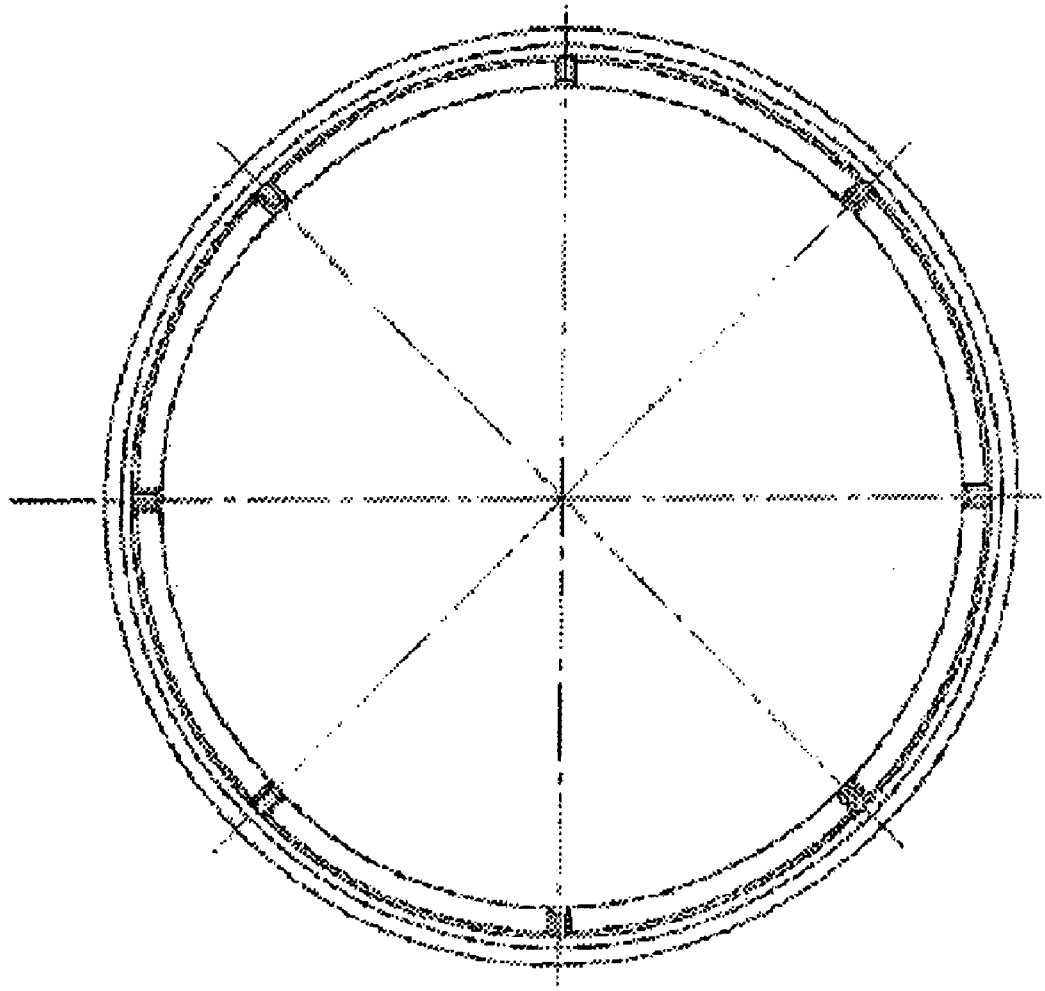
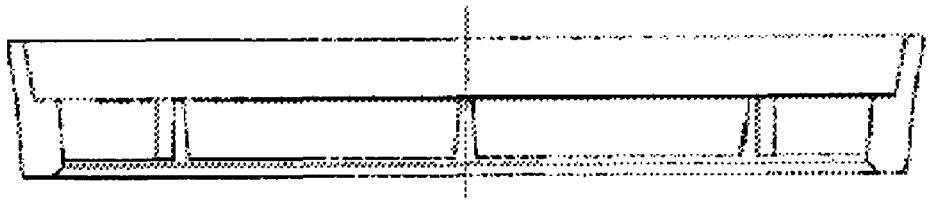

[Fig. 5]
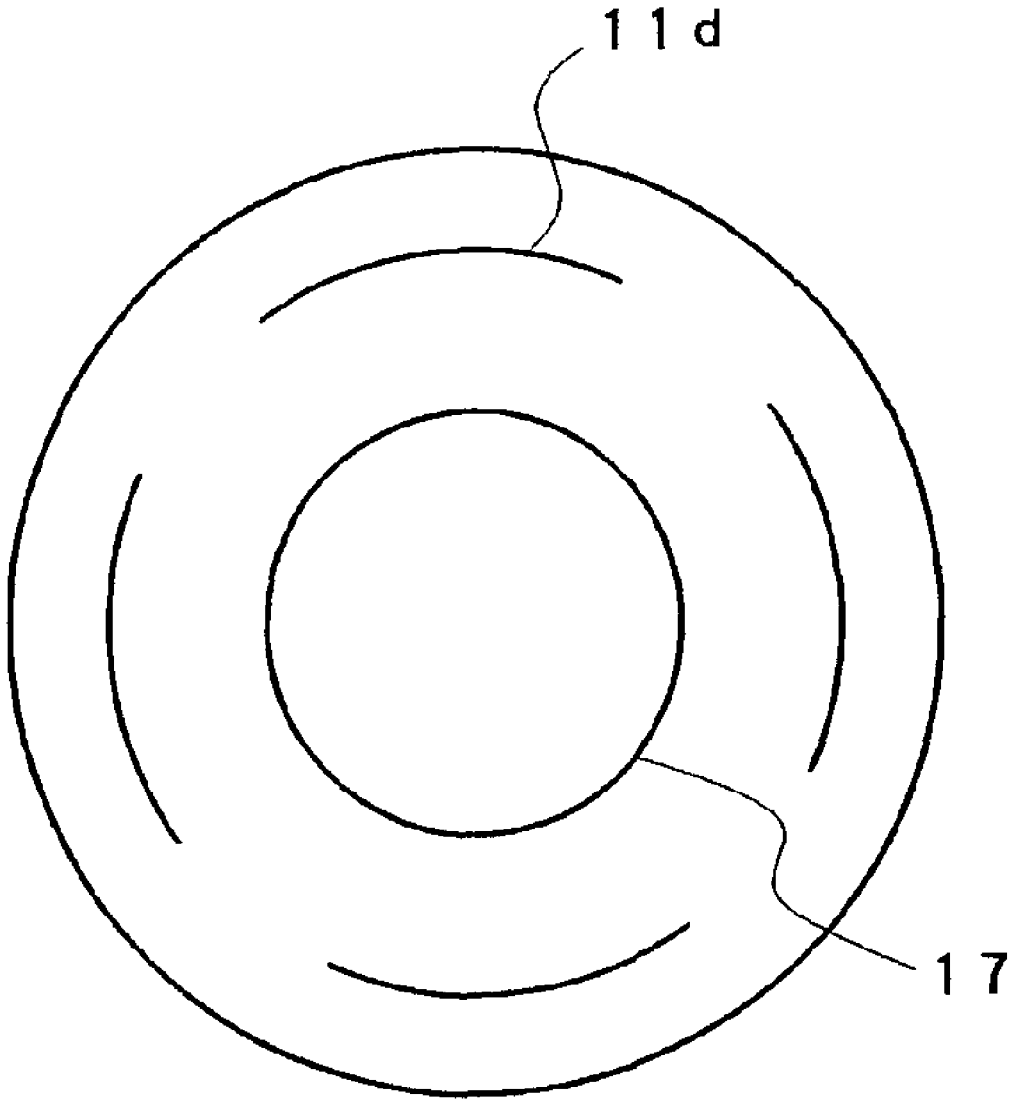

[Fig. 6]
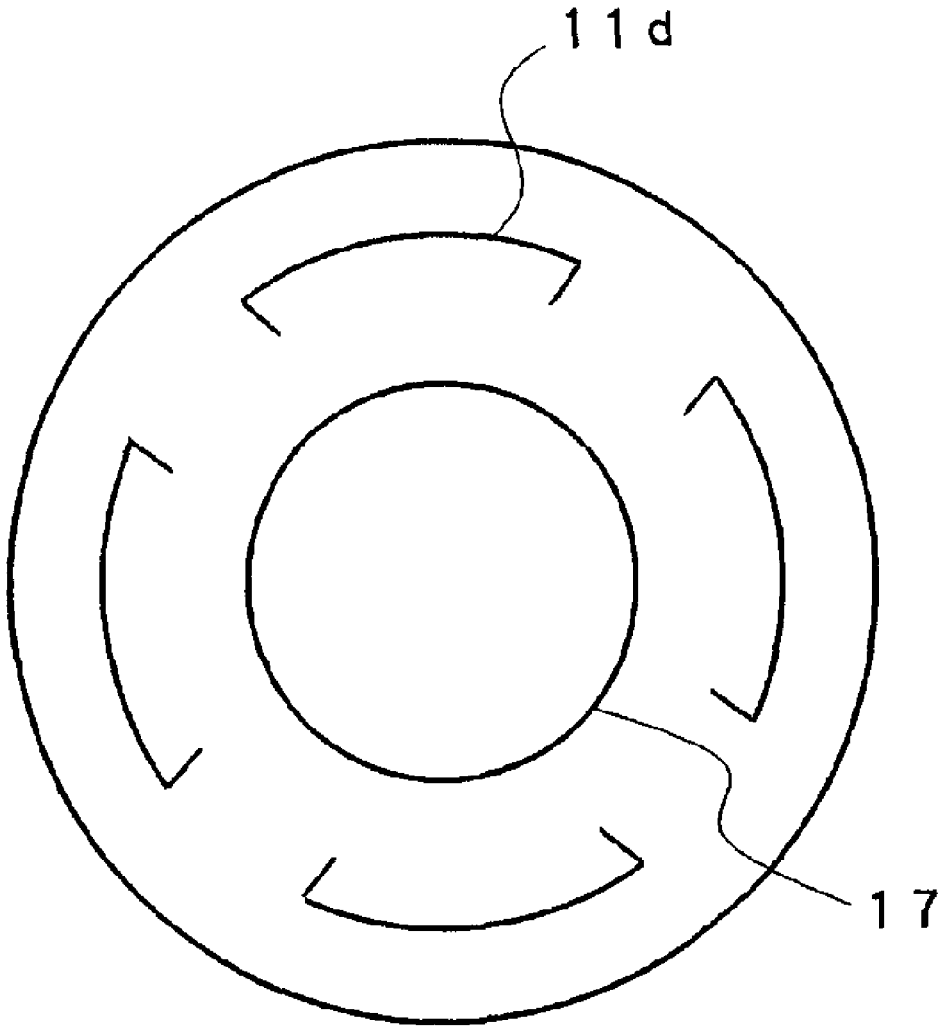

[Fig. 7]
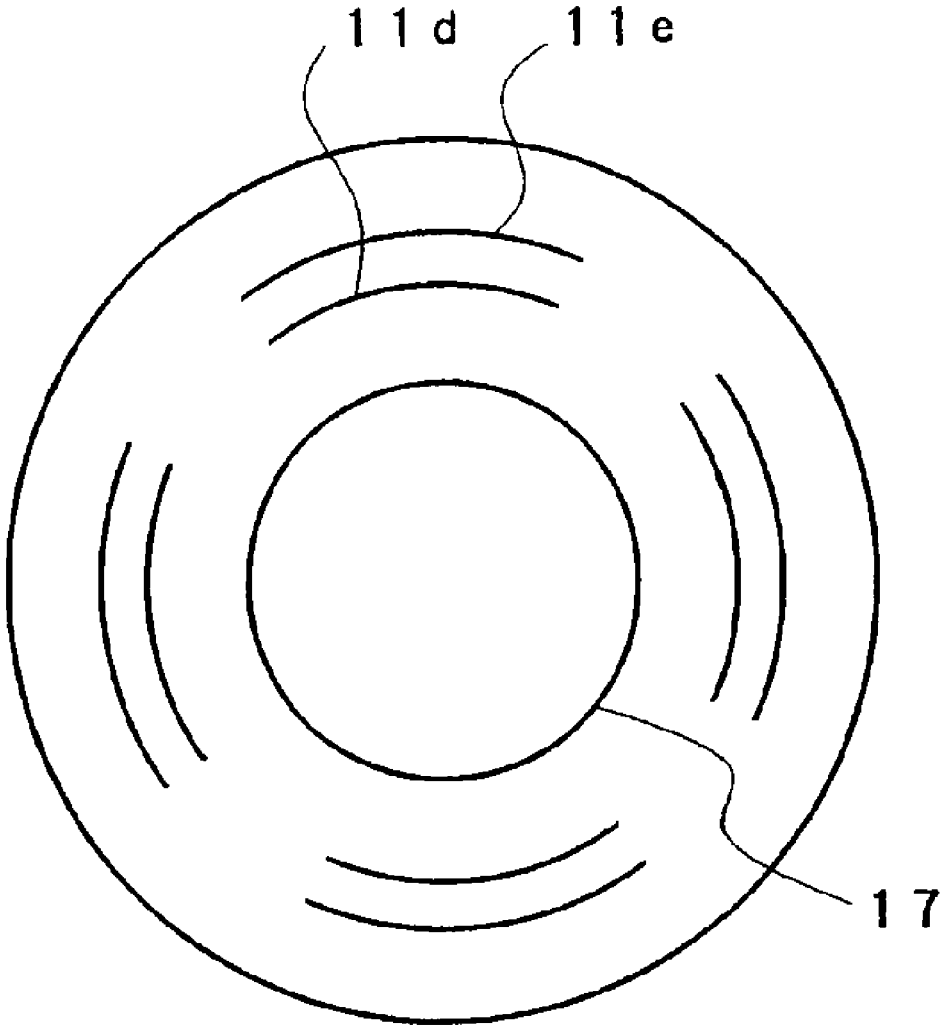

SPEAKER DEVICE

TECHNICAL FIELD

The present invention relates to a dynamic speaker device in which a connected portion between a voice coil bobbin and a diaphragm is provided with sufficient mechanical strength, thereby enhancing endurance.

BACKGROUND TECHNIQUE

According to a dynamic speaker, a voice coil bobbin around which a voice coil is wound is basically mounted on an inner peripheral edge of a conical diaphragm, an outer peripheral edge of the diaphragm is mounted on a frame through an edge portion, and the voice coil bobbin is mounted on the frame through a damper. That is, the edge portion and the damper constitute a suspension of a vibration body such as the diaphragm or the voice coil bobbin.

For example in a speaker for reproducing deep bass called woofer or subwoofer which is utilized in an audio system for a vehicle, since a diameter of the diaphragm is limited, a large amplitude stroke of the diaphragm is secured so that sufficient sound pressure level in bass can be secured.

Especially a damper constituting a suspension of the vibration body must have a function for securing an amplitude stroke of the same level as that of the edge portion while avoiding contact of the voice coil with a pole piece or a yoke constituting a magnetic gap.

Therefore, it is difficult to provide the damper with large compliance, and there is a problem that in a damper of the speaker which secures a large amplitude stroke, a non-linear movable load is provided and power linearity is deteriorated. In addition, there is also a problem that mechanical fatigue of the damper occurs faster than the edge portion.

To secure compliance of the damper, a corrugation damper having a corrugated cross section shape is widely used, but there is a problem that peculiar vibration and scratchy sound and the like are generated by deformation of between corrugating adjoined by amplitude motion. This phenomenon remarkably occurs in a speaker having a large amplitude stroke of the diaphragm.

Hence, the present applicant has already filed an application of a speaker device in which for example, a roll-type edge having the same function as that of the edge portion is employed instead of the damper, and rigidity of the diaphragm in the vibration direction can be enhanced. This is disclosed in a publication of unexamined application indicated as Patent Document 1.

According to a structure of the speaker disclosed in Patent Document 1, the problem generated when the damper is used can be solved, and rigidity of the diaphragm in the vibration direction can be enhanced and thus, excellent acoustic feature can be obtained as a bass reproducing speaker.

Patent Document 1: Japanese Patent Application Laid-Open No. 2005-191746

DISCLOSURE OF THE INVENTION

Problem to be Solved by the Invention

In the bass reproducing speaker disclosed in the Patent Document 1, vibration caused by a voice coil which is movable disposed in a magnetic gap is transmitted to a first diaphragm, and a second diaphragm on the side of acoustic radiation is driven through the first diaphragm. In such a structure, means that a bobbin around which a voice coil is wound is coupled to the first diaphragm through an adhesive, and a second diaphragm is also coupled to the first diaphragm through the adhesive is employed.

In the speaker, in a state where an inner peripheral edge of the first diaphragm is in contact with an outer peripheral surface of the voice coil bobbin, they are coupled to each other through an adhesive. Therefore, there remains a problem that adhering strength between the voice coil bobbin and the first diaphragm cannot sufficiently be secured.

Especially in the bass reproducing speaker disclosed in the Patent Document 1 and having large amplitude of the diaphragm, since a large driving force of amplitude is transmitted from the voice coil bobbin to the first diaphragm, a large driving force is repeatedly applied to a coupled portion between the voice coil bobbin and the diaphragm.

As a result, there is a problem that the coupled portion between the voice coil bobbin and the diaphragm is prone to be peeled off, and endurance is poor. When the coupled portion between the voice coil bobbin and the diaphragm is peeled off, this brings a critical result that the speaker device of this kind cannot reproduce high quality sound.

It is an object of the present invention to employ preferably a speaker device having large amplitude of a diaphragm, and to provide a probability that a coupled portion between a voice coil bobbin and a diaphragm is peeled off is largely reduced, and endurance of the speaker device is enhanced.

Means for Solving the Problem

The present invention has been achieved to solve the problem, and as described in claim 1, according to a preferable basic mode of the speaker device, there is provided a speaker device equipping a first diaphragm in which an outer peripheral edge is connected to a frame through a first edge portion and in which an inner peripheral edge is connected to a voice coil bobbin, which the inner peripheral edge of the first diaphragm is accommodated in an adhesive receiver disposed on a peripheral surface of the voice coil bobbin, and the first diaphragm, the adhesive receiver and the voice coil bobbin are connected to each other by an adhesive filled into the adhesive receiver, the adhesive receiver is formed by an annular bottom surface and a peripheral wall which cylindrically rises from a peripheral edge of the bottom surface, an adhesive reservoir having a U-shaped cross section is formed between the adhesive receiver and the outer peripheral surface of the voice coil bobbin in a state where the adhesive receiver is disposed on the outer peripheral surface of the voice coil bobbin, a step rising from the bottom surface toward an acoustic radiation is formed on the adhesive receiver in the adhesive reservoir, and the adhesive reservoir is embedded by the adhesive in a state where the inner peripheral edge of the first diaphragm abuts against an upper surface of the step.

According to the structure, the inner peripheral edge of the diaphragm is embedded by the adhesive filled into the adhesive receiver, and the diaphragm, the adhesive receiver and the voice coil bobbin are strongly connected to each other. Especially, the contact area with respect to the voice coil bobbin can be increased by largely securing the size of the adhesive receiver along the longitudinal direction of the voice coil bobbin. Therefore, the probability that the coupled portion between the voice coil bobbin and the diaphragm is peeled off can largely be reduced.

BRIEF DESCRIPTION OF THE DRAWINGS

FIG. 1 is a partial sectional view showing an embodiment of a speaker device of the present invention;

FIG. 2 is an enlarged sectional view of especially a first diaphragm of the speaker device shown in FIG. 1;

FIG. 3 are a plan view and a sectional view of an adhesive receiver used in the speaker device shown in FIG. 1;

FIG. 4 are a plan view and a sectional view showing another structure example of the adhesive receiver;

FIG. 5 is a plan view showing an arrangement example of ribs with respect to the first diaphragm;

FIG. 6 is a plan view showing another arrangement example of the same ribs; and FIG. 7 is a plan view showing another arrangement example of the same ribs.

DESCRIPTION OF THE REFERENCE NUMERALS

1 pole yoke
2*a*, 2*b* magnet
3 plate
4 sub-plate
5 magnetic gap
6 voice coil
7 voice coil bobbin
8 adhesive receiver
8*a* inner diameter portion
8*b* bottom surface
8*c* peripheral wall
8*d* step
11 drive cone (first diaphragm)
11*a* inner peripheral edge (folded portion)
11*b* rising portion
11*c* falling portion
11*d* first rib
11*e* second rib
12 frame
13 first edge portion
14 diaphragm (second diaphragm)
15 second edge portion
16 gasket
17 center cap
A hermetic space
S adhesive (adhesive reservoir)

BEST MODE FOR CARRYING OUT THE INVENTION

A speaker device of the present invention will be explained based on figures illustrated in the embodiments. A front surface and a back surface described hereinafter are that a front surface is defined as an acoustic radiation side, and a back surface is defined as an opposite side of the acoustic radiation side. FIG. 1 shows a first embodiment. FIG. 1 illustrates a sectional view of a right half portion of the speaker device from its center line. A numeral 1 is a pole yoke in which a center portion is formed into hollow. Ring magnets 2*a* and 2*b* are placed on a disk flange 1*a* which is integrally formed on a bottom of the pole yoke 1, and the magnets 2*a* and 2*b* are mounted coaxially with a cylindrical portion 1*b* of the pole yoke.

A ring plate 3 is mounted on upper surface of the magnets 2*a* and 2*b*. A ring sub-plate 4 is mounted to be fitted into an inner peripheral surface of the plate 3. With this structure, a magnetic gap 5 is formed between the inner peripheral surface of the ring sub-plate 4 and the outer peripheral surface (outer peripheral surface of the cylindrical portion 1*b*) of the pole yoke 1.

A cylindrical voice coil bobbin 7 around which a voice coil 6 is wound is mounted on the magnetic gap 5 such that the voice coil bobbin 7 can move along a longitudinal direction (vertical direction in the figure) of the pole yoke 1. An annular adhesive receiver 8 is mounted on an outer peripheral surface of the voice coil bobbin 7 near its upper end. A cross section of the adhesive receiver 8 upwardly forming a peripheral sidewall is of an L-shape so as to form a U-shaped adhesive reservoir between the adhesive receiver 8 and the voice coil bobbin 7.

An inner peripheral edge 11*a* of a drive cone 11 as a first diaphragm enters the U-shaped portion formed between the adhesive receiver 8 and the voice coil bobbin 7. The inner peripheral edge of the drive cone 11 is coupled to an outer peripheral surface of the voice coil bobbin 7 by an later-described adhesive injected into the U-shaped portion. Detailed structures of the adhesive receiver 8 and a mounting example of the drive cone 11 on the voice coil bobbin 7 utilizing the adhesive receiver will be explained in detail later based on FIGS. 2 and 3.

The drive cone 11 is formed of synthetic resin material and formed into a substantially cylindrical shape as a whole, for example. The drive cone 11 is formed with a conical rising portion 11*b* rising from an inner peripheral edge of the drive cone 11 in an acoustic radiation direction (direction toward a front surface of a later-described diaphragm, i.e., upward in FIG. 1), and a falling portion 11*c* falling in a conical shape in a direction opposite from the acoustic radiation. Further, the falling portion 11*c* is located outside of the rising portion 11*b*.

Ribs 11*d* and 11*e* are integrally formed on an upper surface of the falling portion 11*c* of the drive cone 11 in the acoustic radiation direction inside and outside of the falling portion 11*c*. In this embodiment, one of a rib formed near the rising portion 11*a* of the drive cone 11 is called a first rib 11*d*, and a rib formed near the edge portion 13 is called a second rib 11*e*.

The outermost peripheral edge of the drive cone 11 is formed into a flange, and the roll first edge portion 13 is interposed between this flange 11*f* and a frame 12. That is, the drive cone 11 is supported by the frame 12 such that the drive cone 11 can reciprocate in the acoustic radiation through the roll edge portion 13.

Grooves are formed in an annular apex formed at a boundary between the rising portion 11*b* and the falling portion 11*c* of the drive cone 11 and along tip ends of the first rib 11*d* and the second rib 11*e*, respectively. A second diaphragm 14 (simply refer to diaphragm, hereinafter) is mounted on a front surface of the drive cone 11 by an adhesive (not shown) injected into each of the grooves. A mounting structure of the diaphragm 14 on the drive cone 11 will be explained in detail later based on FIG. 2.

An outer peripheral edge of the diaphragm 14 is supported in an opening edge of the frame 12 through an wave-shaped second edge portion 15. A numeral 16 is a gasket 16, which sandwiches an outer peripheral edge of the edge portion 15 at an opening edge of the frame 12.

The diaphragm 14 disclosed in this embodiment is formed into an annular shape such that this occupies an outer region of a speaker diameter, and a center cap 17 which occupies a relatively large area is mounted on a central portion of the diaphragm 14. That is, an outer peripheral edge of the center cap 17 is folded in a side of the opposite direction from the acoustic radiation direction (downward in the figure), the outer peripheral edge enters a groove formed in the diaphragm 14, and the outer peripheral edge is mounted on the diaphragm 14 in this groove by an adhesive (not shown). A mounting structure of the center cap 17 on the diaphragm 14 will be described in detail later based on FIG. 2.

In the outer peripheral edge of the diaphragm 14, the wave-shaped edge portion 15 which supports the diaphragm 14 that can vibrate includes a first region 15*a* which is formed to be high in the height and to be wide in width, and a second region 15*b* which is formed to be low and narrow, the second region 15*b* being formed on the side of the frame 12*a* in the respect to the first region 15*a*. With this structure, the edge portion 15 constituting the first region 15*a* can secure large compliance, and the edge portion 15 operates to excellently follow the drive of large amplitude of the diaphragm 14.

In the speaker device having the above-described structure, it is desirable that a space indicated by numeral A surrounded by the edge portion 15, the diaphragm 14, the drive cone 11, the edge portion 13 and the frame 12 is formed hermetical state, gas in the hermetic space A functions as an air spring, and the diaphragm 14 through the drive cone 11 functions to be integrally driven with the drive cone 11.

FIG. 2 is an enlarged sectional view of the especially drive cone 11 in the speaker device shown in FIG. 1. FIG. 2 is used mainly for explaining the mounting structure of the drive cone 11 on the voice coil bobbin 7 and the mounting structure of the diaphragm 14 on the drive cone 11.

The adhesive receiver 8 shown in FIG. 2 is formed into the annular shape as explained based on FIG. 1, and is disposed on the outer peripheral side of the voice coil bobbin 7. The inner peripheral edge 11*a* of the drive cone 11 is mounted on the voice coil bobbin 7 by an adhesive S filled into the U-shaped adhesive reservoir formed between the voice coil bobbin 7. FIG. 3 shows a structure of the adhesive receiver 8, FIG. 3(A) illustrates a plan view of the adhesive receiver, and FIG. 3(B) illustrates a sectional view taken along in the arrow direction from the line a-a in FIG. 3(A).

As shown in FIG. 3, an inner diameter portion 8*a* of the adhesive receiver 8 is formed slightly greater than a diameter of a cylindrical outer peripheral surface of the voice coil bobbin 7. The adhesive receiver is formed with an annular bottom surface 8*b* and a peripheral wall 8*c* which cylindrically rises from a peripheral side edge of the bottom surface. With this, as shown in FIG. 2, a U-shaped adhesive reservoir (shown with the same numeral S as the adhesive) in which the adhesive S can be filled is formed by the outer peripheral surface of the voice coil bobbin 7, and the bottom surface 8*b* and the peripheral wall 8*c* of the adhesive receiver.

The adhesive receiver 8 is formed with steps 8*d* which rise in the acoustic radiation direction from the bottom surface 8*b* in the adhesive reservoir S. Three steps 8*d* are formed along the circumferential direction as shown in FIG. 3. The inner peripheral edge 11*a* of the drive cone 11 abuts an upper surface of the step 8*d*, and in this state, the inner peripheral edge 11*a* of the drive cone 11 is embedded by the adhesive S.

Heretofore it has been described that the steps 8*d* has three steps but the number of the steps 8*d* is not limited, and eight steps 8*d* may be disposed as shown in FIG. 4 for example.

The inner peripheral edge of the drive cone 11 is formed with a folded portion (shown with the same numeral 11*a* as the numeral of the inner peripheral edge) extending in a direction intersecting with the vibration direction of the drive cone. The folded portion 11*a* is embedded by the adhesive S filled into the adhesive receiver 8. With this structure, the drive cone 11, the adhesive receiver 8 and the voice coil bobbin 7 are connected to each other through the adhesive S.

Since the folded portion 11*a* is formed on the inner peripheral edge of the drive cone 11 such as to intersect with the vibration direction, it is possible to solve the problem that the inner peripheral edge of the drive cone 11 receives a driving force of the voice coil bobbin 7 and the inner peripheral edge is peeled off in the vibration direction and the inner peripheral edge comes out.

Further, since the steps 8*d* rising from the bottom surface 8*b* of the adhesive receiver 8 toward the acoustic radiation direction is formed in the adhesive reservoir S, the inner peripheral edge of the drive cone 11 can be fixed stably, and the inner peripheral edge 11*a* of the drive cone can be mounted on the voice coil bobbin 7 through the adhesive receiver 8 at a desired position without inclining the drive cone 11 as a whole.

Further, since the adhesive receiver 8 is dotted with the steps 8*d*, for example, if the adhesive receiver 8 is sufficiently filled with an adhesive, the inner peripheral edge 11*a* of the drive cone 11 is not direct contact with the bottom surface 8*b* and it is embedded. Therefore, a large adhering area can be secured, and the adhering strength in the vibration direction can be enhanced.

In the other hand, the rising portion 11*a* of the drive cone 11 is formed with a first rising portion 11*b*1 rising conically from the inner peripheral edge of the drive cone 11 to the acoustic radiation direction, and a second rising portion 11*b*3 rising conically outwardly further toward the center cap 17 through a bent portion 11*b*2.

As shown in FIG. 2, the annular apex formed at a boundary between the rising portion 11*a* and the falling portion 11*b* of the drive cone 11 is formed with a mounting surface 11*g* of the diaphragm in parallel to a surface intersecting with the vibration direction of the drive cone. An inner peripheral edge 14*d* of the diaphragm 14 is mounted on the mounting surface 11*g* by an adhesive (not shown).

An annular groove 11*h* (hereinafter, this is also called a first groove) is also formed along the mounting surface 11*g* in the outer peripheral edge of the mounting surface 11*g*, i.e., between the mounting surface 11*g* and the falling portion 11*c*. An annular projection (hereinafter, this is also called a first projection) 14*a* is formed such as to project to a back surface of the inner peripheral edge of the diaphragm 14. The projection 14*a* is mounted on the drive cone 11 by an adhesive in a state where the projection 14*a* is inserted into the groove 11*h*.

Grooves 11*i* and 11*j* (hereinafter, there are also called a second groove and a third groove) are formed in each tip ends of the first rib 11*d* and the second rib 11*e* formed on the drive cone 11 along the tip ends.

An annular projection (hereinafter, this is also called a second projection) 14*b* is formed such as to project toward the back surface of the diaphragm 14. The projection 14*b* is in a state inserted into the groove 11*i* formed in the first rib and a projection (this is also called a third projection) 14*c* formed on an outer side of the second projection 14*b* is in a state inserted into the groove 11*j* formed in the second rib. In this state, the projection 14*b* and the projection 14*c* are respectively mounted by adhesives (not shown).

As explained above, in the embodiment shown in FIGS. 1 and 2, the first, second and third projections 14*a*, 14*b* and 14*c* are respectively formed on the back surface of the diaphragm 14 such as to project therefrom, and in a state where the first to third projections are inserted into the first groove 11*h* formed in the apex of the drive cone 11 and the second and third grooves 11*i* and 11*j* formed in the tip ends of the ribs 11*c* and 11*d*, the first to third projections are respectively mounted by adhesives (not shown).

On the other hand, the center cap 17 is mounted on the central portion of the diaphragm 14. That is, a groove 14*e* is formed in a front surface of the diaphragm 14, and a folded portion 17*a* directing a direction opposite from the acoustic radiation direction in the outer peripheral edge of the center cap 17 is mounted on the diaphragm 14 in a state where the folded portion 17*a* is inserted along the groove 14*e*.

Although the drive cone 11 and the diaphragm 14 are adhered to each other by an adhesive, the present invention is not especially limited to this, and they may be adhered to each other by a known method such as heat seal.

The ribs 11*d* and 11*e* on the surface of the drive cone 11 are not limited to integrally forming and may be adhered by attaching the adhesive and the like to the surface of the drive cone 11 or by the heat seal and the like.

The rib 11*e* and the groove 11*j* are disposed in an arc form, but the invention is not limited to this only if the diaphragm 14 can be supported, and for example, the rib 11*e* and the groove 11*j* may be disposed circumferentially or in a polygonal form, or they may be disposed to be doted circumferentially.

An adhesive (not shown) is preferably filled into the groove 14*e* formed in the diaphragm 14. With this, the center cap 17 can be mounted on the diaphragm 14 with sufficient mechanical strength.

At a location directly below (back surface side) the diaphragm 14 on which the folded portion 17*a* of the center cap is mounted, the second projection 14*b* formed on the diaphragm 14 is mounted on the annular groove 11*i* formed in the first rib 11*c* of the drive cone 11. With this, the center cap 17 reciprocates and vibrates in the acoustic radiation direction together with the diaphragm 14, and sufficient sound pressure level in bass region can be secured.

Therefore, according to the above-described structure, the diaphragm 14 is mounted on the drive cone 11 at various portions along a plurality of circumferential directions in the back surface. Since the first rib 11*d* and the second rib 11*e* which support the diaphragm 14 are integrally formed on the drive cone 11 in the acoustic radiation direction, in the drive cone 11 and the diaphragm 14 mutually, the rigidity in the vibration direction can further be enhanced. Therefore, even if the diaphragm 14 is driven with especially large amplitude, the diaphragm 14 is integrally driven together with the drive cone through the drive cone 11.

The first to third projections 14*a*, 14*b* and 14*c* formed on the back surface of the diaphragm 14 are adhered in the state where they are inserted into the first to third grooves 11*h*, 11*i* and 11*j* formed in the drive cone 11. Therefore, the probability of inconvenience that the diaphragm 14 is peeled off and the like from the drive cone 11 can remarkably be reduced. With this, it is possible to provide a speaker device having excellent endurance.

The drive cone 11 has the first rising portion 11*b*1 rising substantially in parallel to the acoustic radiation direction. Therefore, it is possible to efficiently transmit vibration from the voice coil 6*b* to the drive cone 11 and to the diaphragm 14, and it is possible to stably provide high quality reproduced sound.

The first and second ribs shown in FIGS. 1 and 2 may be disposed on the front surface of the drive cone 11 in annular shape, elliptic shape or polygonal shape such as a arrangement to surround the inner peripheral edge of the drive cone 11. Although the first and second ribs are different from each other described in the embodiment, they may be connected to each other.

For example, each rib may be cut in a direction perpendicular to the acoustic radiation direction as shown in FIG. 5, a cross section of the rib may be substantially of arc shape, and the plurality of ribs may be disposed circumferentially such as to surround the inner peripheral edge of the drive cone. Examples of arrangement are shown in FIGS. 6 and 7, and the arrangement is not limited to those.

The drive cone 11 has such a shape that an angle formed between the first rising portion 11*b* and an outer peripheral surface of the voice coil bobbin 7 is more acute than an angle formed between the second rising portion 11*c* and the outer peripheral surface of the voice coil bobbin 7. Therefore, it is possible to form the rising portion 11*a* having great inclination from the inner peripheral edge of the drive cone 11 to the bent portion, it is possible to efficiently transmit vibration from the voice coil to the drive cone and to the diaphragm as compared with a speaker device having a diaphragm and a drive cone such as having no bent portion.

Concerning the drive cone 11, the first rib and the second rib may be integrally formed and not especially limited. Especially when the drive cone 11 is integrally formed with the first rib and the second rib, even if the drive cone 11 and the diaphragm 14 are driven such that the amplitude becomes great, since the first rib and the second rib are integrally formed, it is possible to prevent a connection with respect to the drive cone from being destroyed, and a critical problem that a sound cannot be reproduced can be prevented.

A integrally forming is a known method that can be used, and for example, the drive cone 11, the first rib and the second rib can be integrally formed by injection molding.

The invention claimed is:

1. A speaker device comprising a first diaphragm in which an outer peripheral edge is connected to a frame through a first edge portion and in which an inner peripheral edge is connected to a voice coil bobbin, wherein the inner peripheral edge of the first diaphragm is accommodated in an adhesive receiver disposed in an outer peripheral surface of the voice coil bobbin, the first diaphragm, the adhesive receiver and the voice coil bobbin are connected to each other by an adhesive filled into the adhesive receiver, the adhesive receiver is formed by an annular bottom surface and a peripheral wall which cylindrically rises from a peripheral edge of the bottom surface, an adhesive reservoir having a U-shaped cross section is formed between the adhesive receiver and the outer peripheral surface of the voice coil bobbin in a state where the adhesive receiver is disposed on the outer peripheral surface of the voice coil bobbin, a step rising from the bottom surface toward an acoustic radiation is formed on the adhesive receiver in the adhesive reservoir, and the adhesive reservoir is embedded by the adhesive in a state where the inner peripheral edge of the first diaphragm abuts against an upper surface of the step.

2. The speaker device according to claim 1, wherein the inner peripheral edge of the first diaphragm is formed with a folded portion extending in a direction intersecting with a vibration direction of the diaphragm, and the folded portion is embedded by an adhesive filled into the adhesive receiver.

3. The speaker device according to claim 1 or 2, wherein a second diaphragm is provided on the diaphragm on an acoustic radiation side, an inner peripheral edge of the second diaphragm is connected to the diaphragm, and an outer peripheral edge of the second diaphragm is connected to the frame through a second edge portion.

4. The speaker device according to claim 3, wherein the first diaphragm is formed with a rib member which is formed integrally and annularly rises in the acoustic radiation direction, and a back surface of the second diaphragm is supported by a tip end of the rib member.

5. The speaker device according to claim 3, wherein the first diaphragm is formed with a first rising portion which conically rises in the acoustic radiation direction from the inner peripheral edge of the diaphragm, and with a second rising portion which further conically rises outward through a bent portion.

6. The speaker device according to claim 5, wherein an angle formed between the first rising portion and an outer peripheral surface of the voice coil bobbin is more acute than an angle formed between the second rising portion and the outer peripheral surface of the voice coil bobbin.

7. The speaker device according to claim 3, wherein a space surrounded by the first diaphragm, the first edge portion, the second diaphragm, the second edge portion, and the frame is a hermetic space.

* * * * *